US006293540B1

(12) United States Patent
Kovacs

(10) Patent No.: US 6,293,540 B1
(45) Date of Patent: Sep. 25, 2001

(54) CURRENCY DISPENSER SERVICE METHOD

(75) Inventor: Douglas A. Kovacs, North Canton, OH (US)

(73) Assignee: Diebold, Incorporated, North Canton, OH (US)

( * ) Notice: Subject to any disclaimer, the term of this patent is extended or adjusted under 35 U.S.C. 154(b) by 0 days.

(21) Appl. No.: 09/450,086

(22) Filed: Nov. 29, 1999

(51) Int. Cl.[7] ..... B65H 1/00; B65H 1/22
(52) U.S. Cl. ..... 271/162; 271/164
(58) Field of Search ..... 109/63.5; 312/183; 705/43; 902/28, 9, 12, 13, 15; 271/162, 164

(56) References Cited

U.S. PATENT DOCUMENTS

| | | | | |
|---|---|---|---|---|
| 4,348,018 | * | 9/1982 | Bijttebier et al. | 271/10 X |
| 4,660,820 | * | 4/1987 | Shino et al. | 271/9 X |
| 5,150,390 | * | 9/1992 | Kunikawa et al. | 271/9 X |
| 5,152,512 | * | 10/1992 | Yoshida et al. | 271/3.1 X |
| 5,441,246 | * | 8/1995 | Miyata et al. | 271/9.11 X |
| 5,732,941 | * | 3/1998 | Moll | 271/10.07 X |
| 5,785,308 | * | 7/1998 | Flores et al. | 271/9.11 X |
| 5,993,132 | * | 11/1999 | Harres et al. | 414/417 X |
| 6,014,649 | * | 1/2000 | Kobayashi et al. | 705/43 |
| 6,123,329 | * | 9/2000 | Sato et al. | 271/9.01 X |

FOREIGN PATENT DOCUMENTS

| | | | | |
|---|---|---|---|---|
| 63-230426 | * | 9/1983 | (JP) | B65H/1/26 |
| 59-223635 | * | 12/1984 | (JP) | B65H/1/14 |
| 60-71429 | * | 4/1985 | (JP) | B65H/1/26 |
| 2-147527 | * | 6/1990 | (JP) | B65H/3/00 |
| 3-61227 | * | 3/1991 | (JP) | B65H/3/00 |
| 3-85636 | * | 4/1991 | (JP) | B65H/3/00 |
| 3-293223 | * | 12/1991 | (JP) | B65H/1/00 |

* cited by examiner

*Primary Examiner*—Christopher P. Ellis
*Assistant Examiner*—Kenneth W Bower
(74) *Attorney, Agent, or Firm*—Ralph E. Jocke; Daniel D. Wasil; Walker & Jocke

(57) ABSTRACT

An automated banking machine (10) has a secure chest (20). A sheet dispenser assembly is supported on the chest through movable slides (40). The dispenser may be moved outward through an opening (26) in the chest by extending the slides. The dispenser may be disengaged from the slides through use of a portable carrier (50). The portable carrier has a lifting device which is operated to lift the dispenser relative to the slides enabling disengagement therefrom. The dispenser is then movable away from the chest for servicing on the carrier. The dispenser may be re-engaged with the slides after servicing using the portable carrier.

40 Claims, 7 Drawing Sheets

CURRENCY DISPENSER SERVICE METHOD

TECHNICAL FIELD

This invention relates to automated banking machines. Specifically, this invention relates to a method and apparatus for removing a sheet dispenser apparatus from a secure chest of a banking machine and returning the dispenser to the chest after service or other handling.

BACKGROUND ART

Automated banking machines are known in the prior art. One type of automated banking machine, known as an automated teller machine (ATM), allows a bank customer to conduct banking transactions without the necessity of a banking employee directly taking part. Such transactions might include making deposits to accounts, checking balances, transferring funds or dispensing currency or other sheet items. As used herein, the phrase automated banking machine is not intended to limit the scope of the disclosure, but may include any type of device that enables automating transactions involving transfers representative of value.

Other types of automated banking machines may be used to dispense currency to a customer, bank teller, cashier or other service provider. Automated banking machines may dispense various types of sheet items to customers of service providers. For example, automated banking machines used in connection with embodiments of the invention may dispense sheet items such as tickets, scrip, vouchers, coupons, or phone cards. Automated banking machines generally store a multitude of such sheet items in a fashion enabling the machine to quickly deliver one or more items without error.

The devices enabling storage and delivery of the sheet items may at times require maintenance or repair. In automated banking machines such as those made by Diebold, Incorporated, the assignee of the present invention, sheet items that are dispensed are generally held in cassettes. The cassettes are enabled to be replaced quickly by authorized personnel who have gained access to a secure chest portion of the machine which houses the cassettes. This enables authorized personnel to quickly replenish items to be dispensed. This can be done by replacing the cassettes or by removing the cassettes, adding sheets thereto and reinstalling the cassettes.

While replenishing sheet items may readily be accomplished, it is sometimes necessary to conduct more extensive maintenance or repair activities. In the event repair or replacement of certain components of the machine are necessary, the sheet dispenser assembly may need to be removed from the housing. The weight and delicate nature of some components of the sheet dispenser assembly often makes removal and reinstallation of the dispenser mechanism difficult. In many circumstances more than one service person may be required to remove and reinstall the dispenser mechanism. Delicate components of the mechanism may be damaged through improper handling. Very accurate positioning of the mechanism is required for proper operation of the machine which necessitates care during reinstallation. All of these requirements add to the difficulty in servicing the sheet dispenser mechanism.

Thus there exists a need for an apparatus and method for more easily removing, transporting and reinstalling a sheet dispenser assembly of an automated banking machine to facilitate servicing of components of the assembly.

DISCLOSURE OF INVENTION

It is an object of the present invention to provide an apparatus for servicing automated banking machines.

It is a further object of the present invention to provide an apparatus which enables a sheet dispenser of an automated banking machine to be more readily serviced.

It is a further object of the present invention to provide a fixture or carrier apparatus for disengaging a sheet dispenser from an automated banking machine.

It is a further object of the present invention to provide a carrier apparatus for transporting a disengaged sheet dispenser of an automated banking machine away from the housing of the machine to facilitate servicing of the sheet dispenser.

It is a further object of the present invention to provide a method of servicing an automated banking machine.

It is a further object of the present invention to provide a method of servicing a sheet dispenser of an automated banking machine, that reduces the time and cost of removing and reinstalling the sheet dispenser.

Further objects of the present invention will be made apparent in the following Best Modes for Carrying Out Invention and the appended claims.

The foregoing objects are accomplished in an exemplary embodiment of the invention which involves servicing an automated banking machine. The machine includes a secure chest which houses critical components and valuable documents or sheets. The valuable documents or sheets may include for example, currency, coupons, tickets, scrip, vouchers, phone cards and/or other items.

A dispenser mechanism for handling the valuable documents is releasably mounted on a movable slide device supported on the chest. To access the dispenser mechanism for servicing a secure chest door is opened by authorized personnel. The chest door is moved to dispose the door from an opening to the interior of the chest. The dispenser mechanism is extendable through the opening in the chest to provide access for service of the mechanism. In the exemplary embodiment the dispenser mechanism includes a document delivery device for delivering documents to a user during operation of the machine. The dispenser mechanism also includes a number of dispenser modules for storing and selectively dispensing documents stored in cassettes. Each dispenser module is capable of selectively picking documents from the cassettes, which documents are delivered by a transport to the document delivery device.

In an exemplary service method of the invention the dispenser mechanism is extended through the access opening of the chest while supported on a slide device. Moving the dispenser outward from the chest on the slide device provides greater access to components of the dispenser mechanism. Having easier access to the dispenser mechanism facilitates repairs and/or replacement of components by service personnel. Sometimes it is desirable or necessary to remove the dispenser mechanism entirely from the machine for service or replacement. The present invention provides a method of separating and removing the dispenser assembly from the balance of the banking machine to facilitate repair or replacement. The exemplary method of the invention also facilitates reinstallation of the dispenser mechanism in the machine.

In the exemplary embodiment of the invention, with the dispenser assembly extending through the opening of the chest and supported on the slide device, a portable carrier is connected to the dispenser assembly. A lifting mechanism on the carrier is operated to raise the dispenser mechanism upward so it is no longer supported on the slide device. As the dispenser mechanism is raised it is disengaged from the slide device. The dispenser is then movable in supporting connection with the carrier. The separated dispenser mechanism may be moved away from the chest to provide greater access for servicing or repair of components of the mechanism or components in the interior of the chest. After the repairs or other service activities are complete the carrier is used to again place the dispenser mechanism in supporting connection with the slide device. The dispenser mechanism is then retracted into the chest while supported on the slide device. The chest door may then be closed and the automated banking machine placed back in operation.

BEST MODES FOR CARRYING OUT INVENTION

Figure 1:
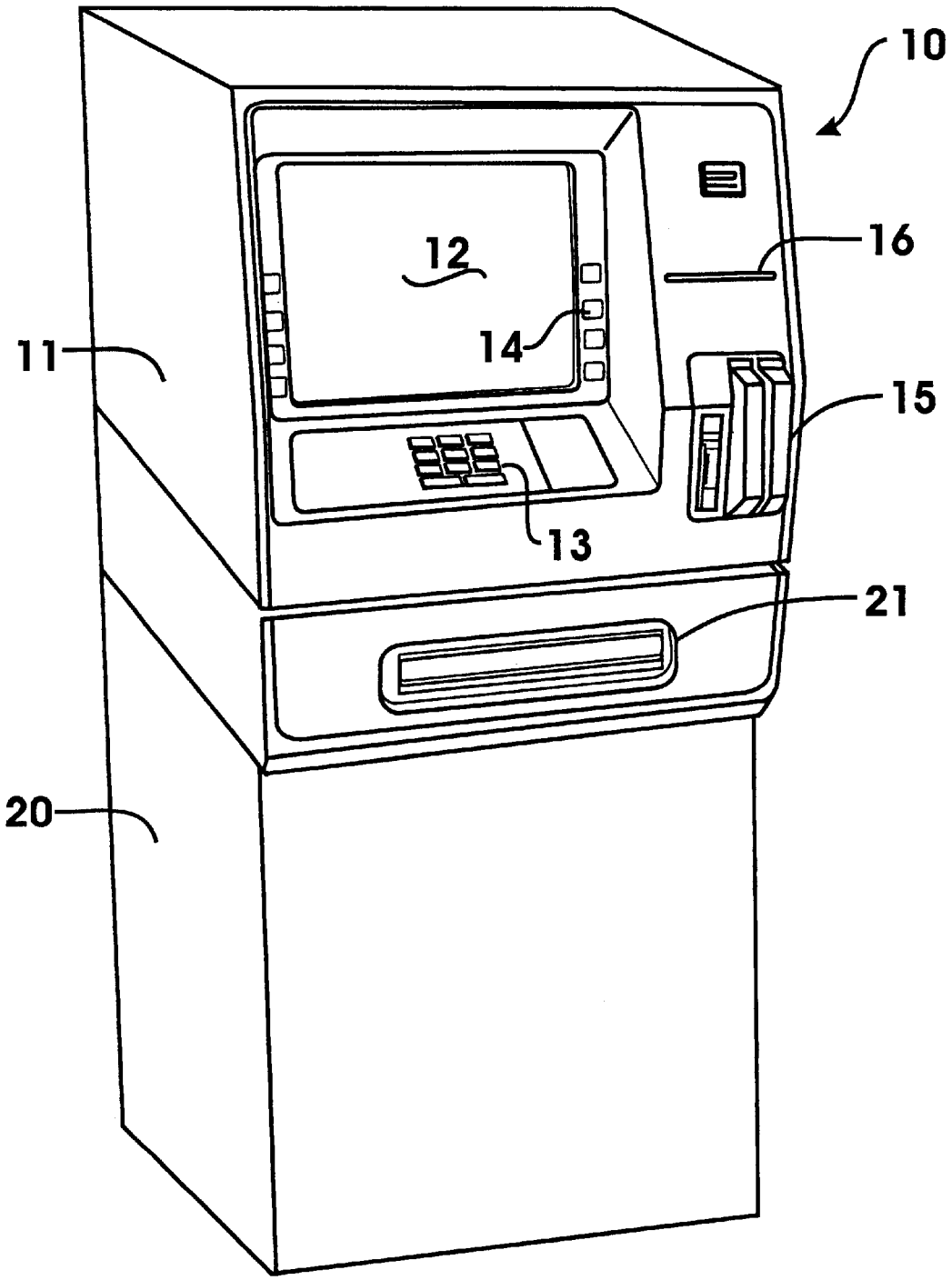
FIG. 1 is an isometric view of an automated banking machine used in connection with an exemplary embodiment of the invention, which machine includes a customer interface portion and a secure chest portion.
Figure 3:
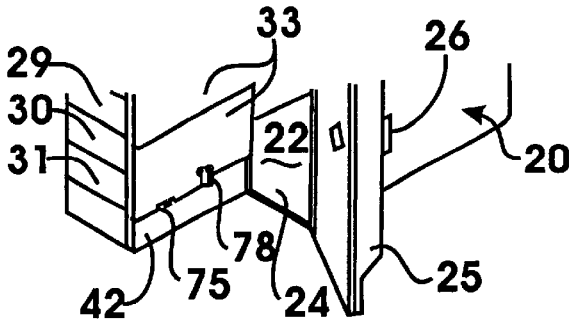
FIG. 3 is a partial isometric exploded view of the secure chest with the sheet dispenser extended through the opening and including a dummy bin attached to the bottom of the dispenser.

Referring now to the drawings and particularly to FIG. 1 there is shown therein an automated banking machine used in connection with an exemplary embodiment of the present invention, generally indicated 10. The automated banking machine 10 is an automated teller machine (ATM) and as such includes a customer interface portion and a document delivery portion. The customer interface portion is supported on an upper housing 11. The interface portion includes a display 12, such as a CRT screen or other output devices for providing outputs such as visual messages and prompts to a customer. The interface also includes input devices such as a card reader 15, a keypad 13 and function buttons 14. The customer interface portion also includes a receipt printer outlet 16 and may include other or different transaction function devices.

A document delivery portion of machine 10 is contained within a secure chest 20. A first opening 21 is provided for delivery of sheets or documents to a user of the machine. Other embodiments of automated banking machines used in connection with the invention may have a different type interface portion. For example, other embodiments may not include an interface portion on or adjacent to the chest portion. Such alternative machines may be operated as a document delivery device only. Such embodiments may be used to deliver sheets or documents to a cashier, bank teller or other service provider. Such alternative embodiments may include a remotely positioned operator interface which selectively causes documents to be delivered through opening 21.

Figure 2:
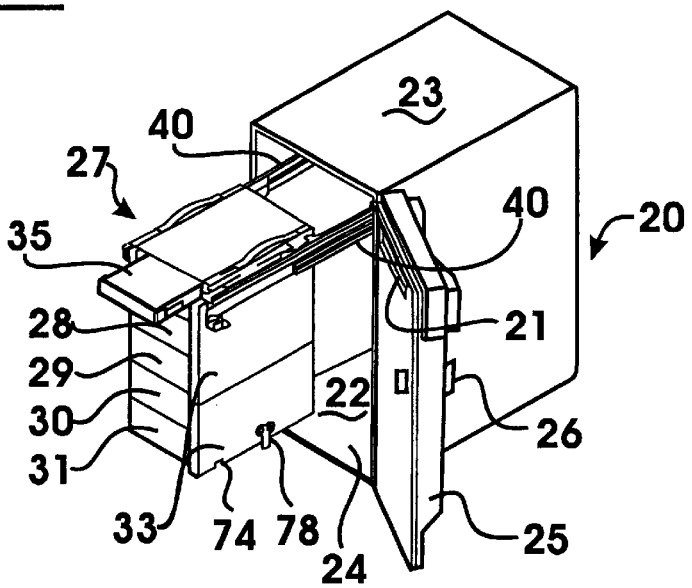
FIG. 2 is an isometric exploded view of the secure chest portion with an access door open and a sheet dispenser extended through an opening.

In FIG. 2, the chest portion 20 of the banking machine is shown in more detail. The chest encloses a secure area 22. Chest 20 includes an upper wall 23 which supports the housing 11 and customer interface portion of the banking machine in the exemplary embodiment shown in FIG. 1. Chest 20 also has a service opening 24 and a door 25 which selectively closes opening 24. When the banking machine is in use, area 22 is closed by door 25 and is secured and locked through use of a locking device 26. Any of a number of known devices may be used as locking device 26 to secure the door in a closed position.

Secure area 22 of chest 20 is used to house numerous components of the banking machine. One of these components is a sheet dispenser generally indicated 27. The dispenser 27 includes removable cassettes 28, 29, 30 and 31. The cassettes hold valuable documents or other sheet materials such as currency, coupons, scrip, vouchers, stamps, tickets and phone cards. Each cassette has an associated picker which is selectively operative to remove sheets from the cassette. The construction of the exemplary embodiment shown is such that two cassettes are removably mounted in a dispenser module 33. The dispenser shown has two dispenser modules. Any number of dispenser modules may be included in banking machines used in connection with the invention. Of course the number of dispenser modules is limited by the physical size of chest 20. Although the exemplary embodiment of the invention has two cassettes and document pickers per dispenser module, other embodiments of the invention may have other numbers or arrangements of dispenser modules.

Dispenser modules 33 are secured together in stacked relation. A document presenter 35 is attached to the top of the stack of dispenser modules. Exemplary cassette and picker structures are shown in U.S. Pat. Nos. 5,099,423 and 5,141,127, the disclosures of which are incorporated herein by reference. The combination allows documents from the cassettes to be picked from the cassettes and delivered to the presenter 35. Documents may be selectively moved by the presenter through opening 21 to the user of the machine. Each of the cassettes 28 through 31 inside the dispenser 27 are independently removable therefrom. Each cassette holding location in the dispenser 27 includes a document picker mechanism and belt feed (not shown) which operate to deliver documents to the presenter 35. The dispenser of the exemplary embodiment includes a plurality of feed rolls, belts and other movable members for selectively engaging and moving documents. Motors and other drive devices operate to move these movable members. The drive devices operate in response to signals from a terminal controller which controls the dispensing of documents from the machine.

The dispenser 27 which includes document feeder 35 and dispenser modules 33, is releasably engaged to a pair of slides 40. The slides are mounted in supporting connection with the inside of chest 20. This construction enables the slides and thus the dispenser 27 to be extended and retracted through opening 24 into and out of the chest. In the operative position of the banking machine the dispenser 27 is supported by slides 40. In the exemplary embodiment the dispenser 27 is releasably engaged with the slides and removable therefrom when the dispenser is extended on the slides outside the chest. In the exemplary embodiment the dispenser 27 is disengageable from the slides by moving the dispenser upward relative to the slides.

When the banking machine is in use the door 25 is closed. Slides 40 are retracted resulting in document feeder 35 and dispenser modules 33 being within chest 20. Door 25 is secured closed with lock device 26. Documents or other items are dispensed responsive to signals from the terminal controller and delivered by the presenter 35 through opening 21 which extends through door 25.

Figures 5, 5A:
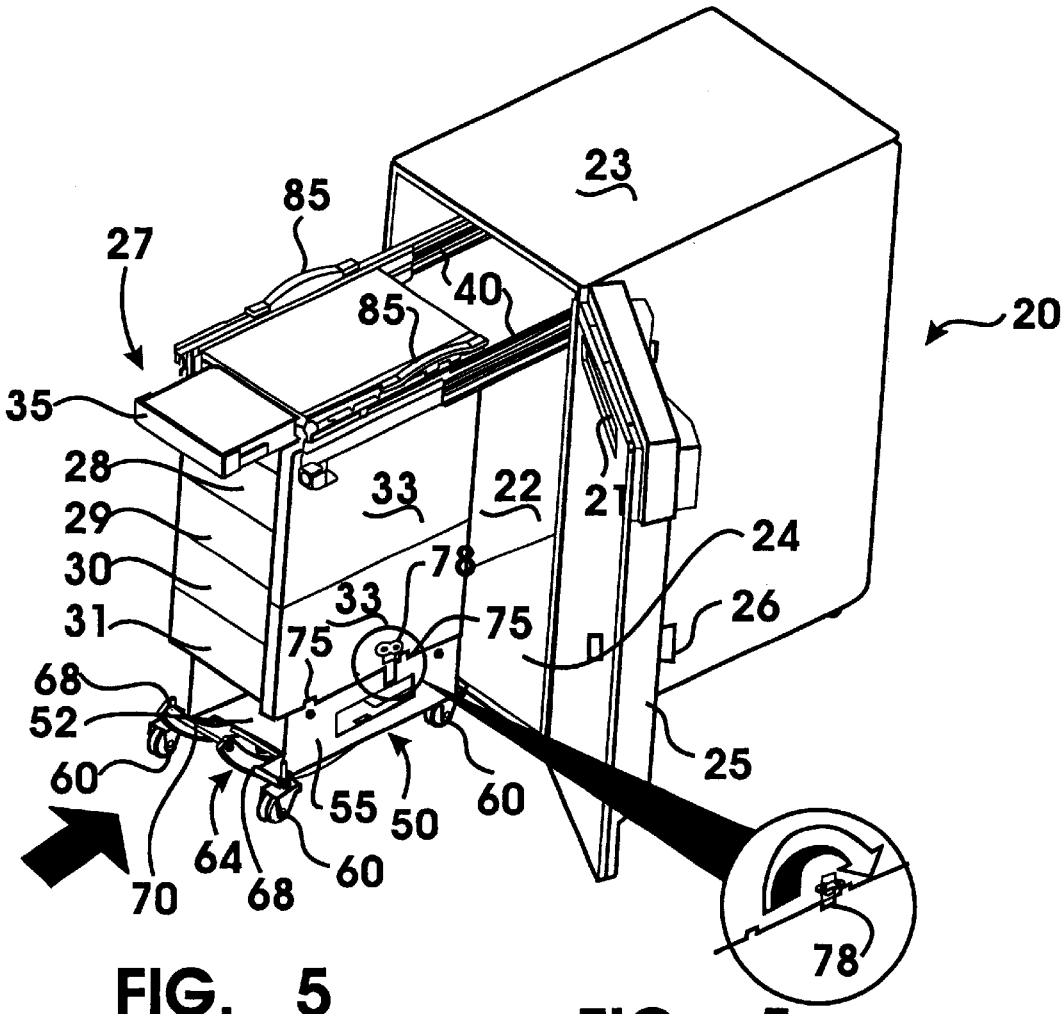
FIG. 5 is an isometric exploded view of the sheet dispenser extended from the chest, with the portable carrier attached.
FIG. 5*a* is a detail view of a latching device shown in FIG. 5 and used for latching the carrier to the sheet dispenser.

In the event that a picker mechanism in connection with one of cassettes 28 through 31 should pick a document that is sensed as not suitable for delivery to a user, the dispenser is able to divert such an item for analysis or processing at a later time. In this regard, the dispenser of the exemplary embodiment may have a reject bin 41 located above uppermost dispenser module 33, as shown in FIG. 5. The reject bin is used to collect any such unsuitable items. Items are directed to the reject bin by reverse driving of the belts and/or other movable members that normally operate to move picked documents to presenter 35. Reject bin 41 may be secured to the upper dispenser module 33 by a releasable latching device. As part of normal service procedures, bin 41 may be removed or otherwise emptied. Any documents or items in reject bin 41 may be analyzed or processed depending on the type. Once items are removed from the reject bin, the bin may be reattached to dispenser module 33 to place the machine back in service. A dummy bin 42 may be secured to the lower dispenser module 33 by a releasable latching device. As part of normal service procedures, bin 42 may be removed.

It may be easily understood that the multitude of cooperating drives, feeders, movable members and devices used in the dispenser to deliver documents to a user could malfunction. Periodic replacement or maintenance of certain components within the dispenser is also desirable to assure reliable operation. It may also be desirable in some circumstances to change the number of cassettes and picker mechanisms to accommodate different denominations of currency, coupons, stamps or other documents. It may also be desirable to replace or upgrade a dispenser. All of these activities require procedures to be performed on the dispenser of the machine. Alternatively, it may be desirable to gain access to components in the chest of the banking machine which are rendered difficult to access by the dispenser.

Slides 40 enable service personnel to extend the dispenser 27 through opening 24, once door 25 has been opened. Extending the dispenser outward provides enhanced access to components of the dispenser for servicing. However, in some instances access to certain components of the dispenser or components in the chest cannot be easily obtained with the dispenser extended through opening 24. In these cases, it would be desirable to disengage the dispenser 27 from slides 40 and move the dispenser in order for work to be performed, or even to possibly replace the dispenser.

Depending on the number of picker mechanisms used and the quantity and weight of the dispenser assembly and/or various cassettes or documents contained therein, the dispenser may be unmanageable by a single service person. In such circumstances an additional service person is required to handle the dispenser, adding to the cost of servicing the machine.

Figure 4:
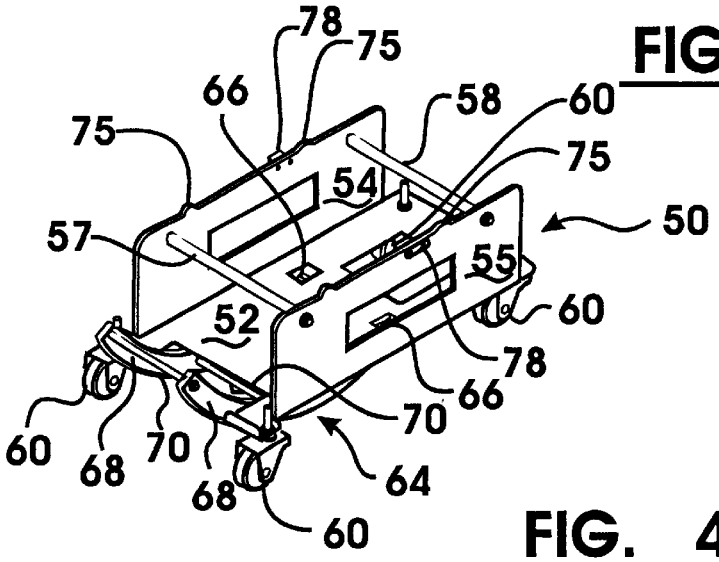
FIG. 4 is an isometric view of an exemplary portable carrier used in connection with an embodiment of the invention.

FIG. 4 shows an exemplary embodiment of a portable carrier, generally indicated 50. The carrier 50 is used for the purpose of lifting, supporting and moving the dispenser 27 so it may be readily removed from engagement with the banking machine. Carrier 50 includes a bottom wall 52, side walls 54 and 55 and supports 57 and 58. Wheels or casters 60 are positioned adjacent each of the four corners of bottom wall 52. The wheels or casters 60 may be locked upon positioning the carrier in a desired position. The construction and size of carrier 50 is such that it compliments the dimensions of the bottom area of the dispenser 27 so that the carrier may engage the underside of the dispenser in supporting relation.

A cradle generally indicated 64, serves as a lifting device. The cradle acts as a lever device as later discussed and is pivotally connected to the bottom wall 52 through pins 66 or other pivoting connection. The cradle 64 includes curved members which in the exemplary embodiment include two identical arcs 68. Arcs 68 are connected together by braces 70. This results in a stable, strong, foot actuated lifting and supporting structure. In order for the cradle 64 not to drag on a floor surface below the carrier 50 when not being used to lift a dispenser, a biasing spring 72 is connected between bottom wall 52 and one of the braces 70. The spring biases the cradle upward. When the cradle is not deliberately engaged with the floor, carrier 50 is able to be moved along the floor surface on wheels 60, in any direction without great effort. In addition, carrier 50 is preferably manufactured from materials so that the overall weight of the carrier is relatively light while providing sufficient strength and support.

Use of the carrier 50 is explained with reference to FIGS. 5 through 8. To service the dispenser, lock device 26 on door 25 is opened by authorized personnel, such as by input of a combination to a combination lock. This enables door 25 to be opened disposing the door from the opening 24. Slides 40 are then extended through opening 24 of chest 20 such that the dispenser 27 is suspended from the slides outside the chest. In the exemplary embodiment, if the dispenser is to be removed from the machine, dummy bin 42 may first be removed from the bottom of the dispenser. This is accomplished by unlatching latches 78 which are disposed on opposite sides of the dispenser. Electrical connections that connect components of the dispenser to other components of the machine are also disconnected. Preferably quick disconnect devices are used for this purpose.

Carrier 50 is moved under the lower dispenser module 33, as shown by the bold arrow in FIG. 5, by a service person. The carrier 50 is properly positioned on the bottom of the dispenser module 33 through the use of an alignment device. In the embodiment shown the alignment device includes matching interlocking surfaces 74 and 75 so that the top of side walls 54 and 55 and the bottom of dispenser module 33 may be aligned. As shown in FIGS. 4 and 5, in the exemplary embodiment the interlocking surfaces on walls 54 and 55 include projections 75 while the surfaces on dispenser module 33 include matching recesses 74. This arrangement assures that when the carrier and the dispenser are engaged they are connected in a manner that will not damage the dispenser. In alternative embodiments, any of a number of suitable arrangements may be used for assuring proper positioning, such as for example pins and holes, spaced projections or self aligning perimeters on the respective mating surfaces. In the exemplary embodiment the interlocking surfaces assure proper alignment of the carrier and dispenser 27. The service person may readily maneuver the carrier side to side and back and forth to affect engagement of the interlocking surfaces 74 and 75. For example, the lower module 33 may have side walls extending lower than the lowest cassette 31. As shown by the bold arrow in FIG. 5, the carrier may be moved under the module 33, however in a slightly unaligned position. The carrier may then be moved sideways, thus interlocking the projections 75 with the recesses 74. However, once engaged, the position of the carrier is fixed relative to the dispenser.

The carrier 50 in the exemplary embodiment is secured to the dispenser 27 by engagement of latching devices 78, which engage a cooperating latching portion on the carrier, such as suitable fingers or projections. Latching devices in other embodiments of the invention may comprise any of a number of mechanisms. These mechanisms may operate with or without removal of the dummy bin. In the exemplary embodiment shown in FIG. 5*a* the latching mechanism includes a pivoting top portion. The top portion is in connection with the dispenser module wall and releasibly engages a latching portion on the carrier. The latching devices are engaged on opposed sides of the dispenser module and carrier. The carrier 50 may require vertical alignment relative to the dispenser module through efforts of the service person in order to engage interlocking surfaces 74 and 75 and to affect securement of latches 78.

In the exemplary embodiment, interlocking surfaces 74 which comprise recesses, as well as latching device 78 are alternatively used to position and secure both bin 42 and carrier 50 to dispenser module 33. In this exemplary embodiment a similar arrangement of interlocking surfaces and latching devices is also used to position and secure dispenser modules 33 together as well as to secure the uppermost dispenser module to the document presenter 35.

Figures 6, 6A:
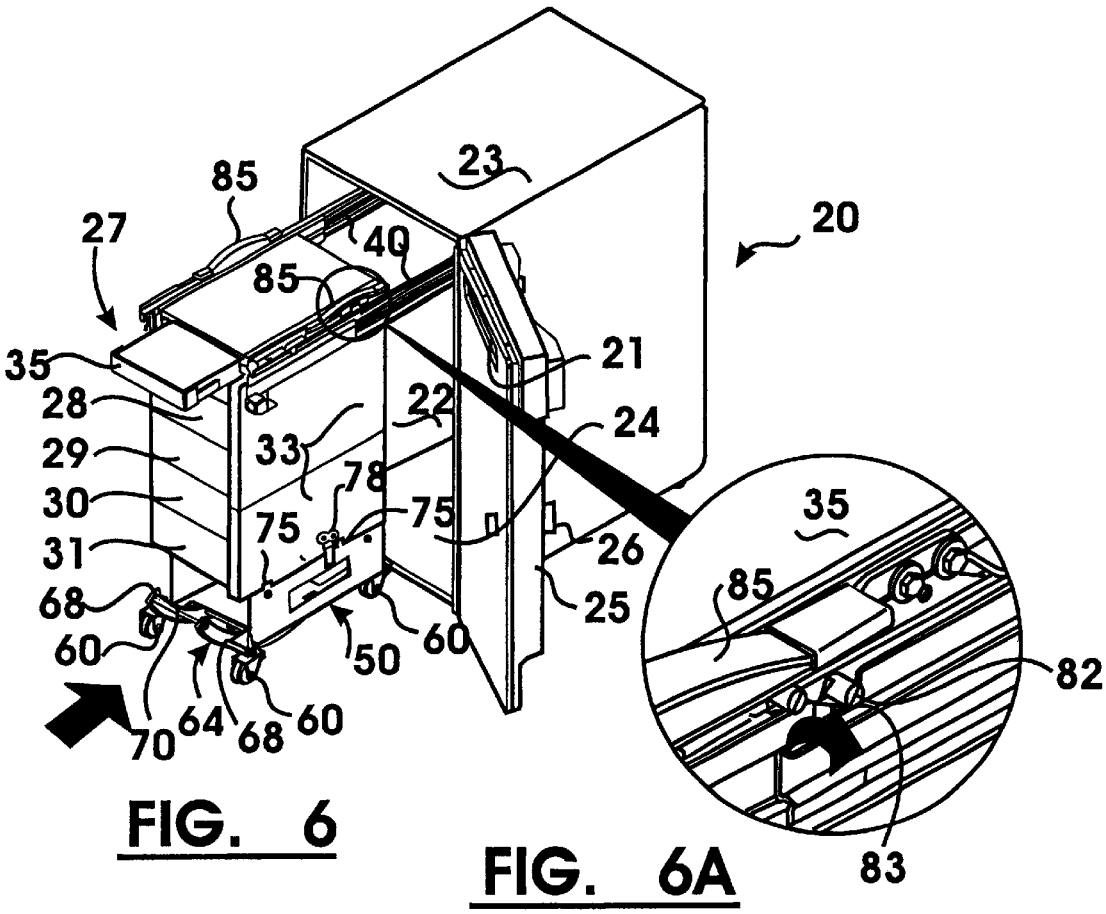
FIG. 6 is an isometric exploded view showing the sheet dispenser in supporting connection with slides, and the carrier attached to the dispenser.
FIG. 6*a* is a detail view of a portion of FIG. 6 showing the engagement of the sheet dispenser with a slide.

Once carrier 50 has been positioned below the lower dispenser module 33 and latched thereto, the disengagement of dispenser 27 from slides 40 may be affected. To this end, the attending service person operates cradle 64 by pushing down on brace 70 with a foot in the direction indicated by the bold arrow in FIG. 6. This movement causes arcs 68 to pivot about pins 66 and to act against the floor surface. This structure of the carrier acts as a lifting device that lifts the dispenser, including presenter 35, upward so it disengages slides 40. The service person is enabled to precisely control the lifting of the dispenser by movement of cradle 64. The foot operation arrangement provides an easy, simple and low cost way of lifting the dispenser. FIG. 6*a* shows in detail the releasable connection between presenter 35 and slides 40 in the exemplary embodiment. When supported on the slides, pins 82 which extend from presenter 35, engage detents 83 on the slides 40 (shown in FIG. 6*a*). As cradle 64 is pivoted upward, presenter 35 is lifted from slides 40 and pins 82 disengage the detents so the dispenser is no longer supported on the slides. This is further shown in FIG. 7 wherein cradle 64 is shown pivoted downward about pins 66 and presenter 35 is raised upwards so it is disengaged from supporting connection with slides 40. Additionally, a fastener such as screws may be attached to the dispenser and slides 40 at an end opposite the detent end. The fastener may be removed, thereby permitting detachment of the dispenser from the slides 40. The dispenser may then be disengaged from the slides. Additionally, a fastener arrangement may be used to prevent the pins 82 from accidentally disconnecting from the slide 40. However, if used, the fastener arrangement would be removed prior to the pins 82 being disengaged from detents 83.

Figure 7:
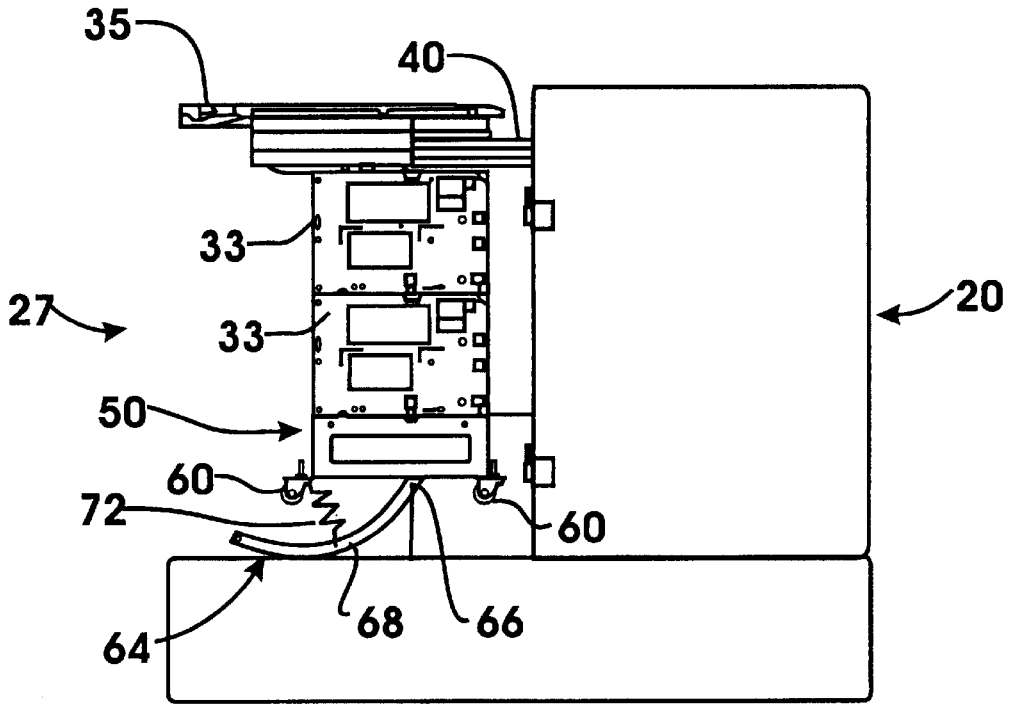
FIG. 7 is a side view of the sheet dispenser with carrier attached showing the operation of a foot operated lift device of the carrier.
Figure 8:
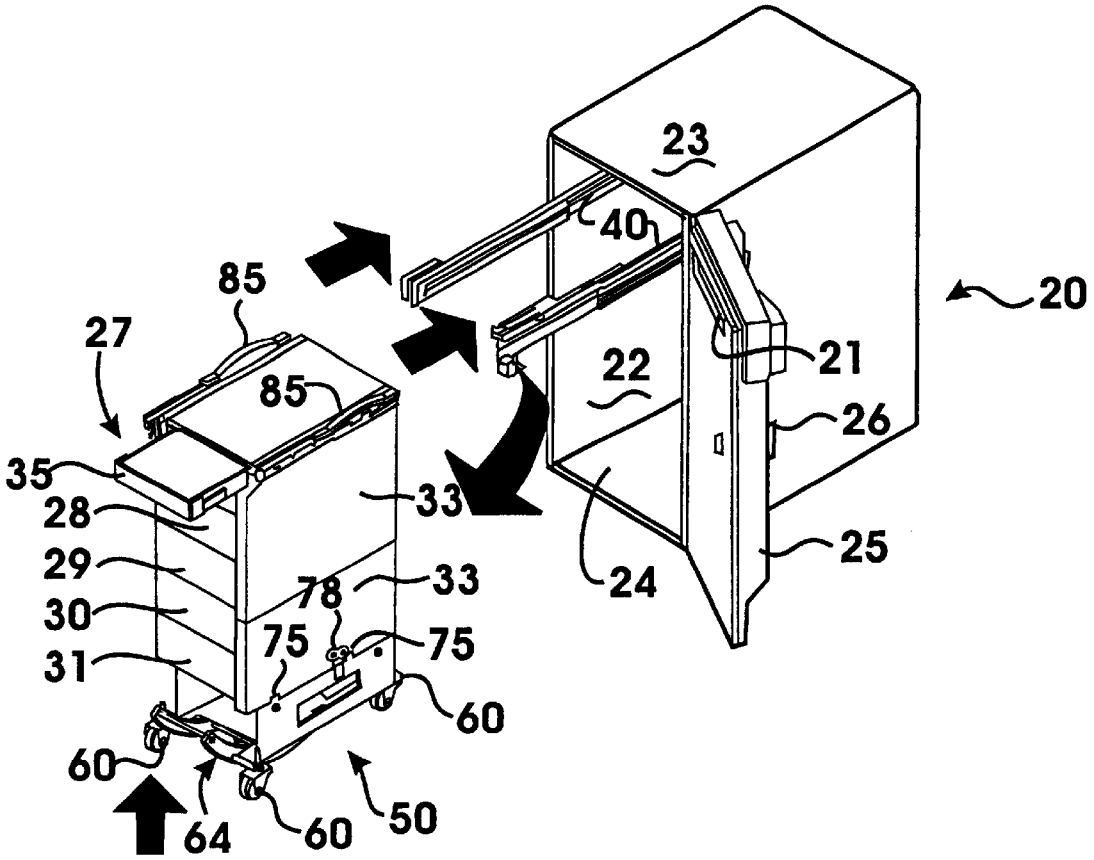
FIG. 8 is an isometric exploded view of the sheet dispenser supported by the carrier and separated from the slides.

In the position shown in FIG. 7 with the carrier 50 and dispenser 27 supported on arcs 68 of cradle 64, the dispenser may be maneuvered such that pins 82 disengage detents 83 on the slides. Handles 85 are provided to allow the service person to manually control the movement of the dispenser during disengagement. The slides 40 may be retracted into the chest while the dispenser is disposed upward from the slides. With the slides retracted the dispenser may be lowered to clear the slides. Alternatively the dispenser may be moved outward away from the slides by the handles while supported in the upward direction. The cradle may then be lowered while the dispenser is moved using the handles to clear the slides.

When cradle 64 is lowered, the carrier 50 supports the dispenser. Spring 72 operates to raise the cradle away from the floor surface to its rest position against bottom wall 52 once the service person disengages their foot from the cradle. From this point, the combination of the dispenser and carrier is supported on wheels 60 and may be easily moved away from chest 20. The wheels enable the dispenser to be moved easily on the floor surface as shown by the bold arrow in FIG. 8. The service person may readily move the dispenser supported on the carrier by engaging the handles 85.

As can be appreciated the total weight and configuration of the combination of the presenter 35, dispenser modules 33 and cassettes (if installed) may be heavy and by itself awkward to lift and maneuver. With the exemplary form of the present invention a service person may readily perform removal and reinstallation of the dispenser in the machine quickly and with minimal risk of damage to the dispenser.

With the dispenser removed from the slides and access to the dispenser and chest interior less restricted, components of the dispenser or in the chest may be serviced and/or replaced. Such would be the case when service is required on elements at the back of the dispenser assembly, the portion of the dispenser closest to the chest when slides are extended. It is in this area that many of the picker, belts and drive components for the documents are located. It should be understood that in the exemplary embodiment, the presenter 35 and dispenser modules 33 may also be readily disengaged or disassembled, and serviced while supported on the carrier. Ready access is achieved so that parts requiring adjustment or replacement may be accessed.

Reassembly of the banking machine is accomplished by moving carrier 50, with dispenser 27 attached thereto back toward chest 20. Once the dispenser assembly is aligned with the chest, cradle 64 is pivoted downward by foot action to lift the dispenser upward. While the dispenser assembly is supported on the cradle, slides 40 may be extended through opening 24 and moved beneath pins 82 on presenter 35. Alignment may be adjusted manually by the service person who engages and moves the dispenser using the handles at the top of the dispenser. When pins 82 are aligned with detents 83, the cradle may be moved relative to the floor surface so that the dispenser moves downward again to engage slides 40. Carrier 50 may then be disengaged from dispenser 27 by disengagement of latches 78. If dummy bin 42 is used, it may now be reattached to the dispenser module. The electrical connectors to components of the dispenser are reconnected. After retracting the slides through opening 24 into the chest, door 25 is closed and the lock device activated to secure the door. The machine is now again ready to deliver documents to a user.

Because carrier 50 is intended to contact the floor or ground surface upon attachment to the dispenser, the vertical position of the dispenser relative to the floor surface becomes important. The exemplary embodiment is shown used with a dispenser which includes two dispenser modules 33 including four cassettes, 28 through 31. While any number of dispenser modules may be used in the dispenser, carrier 50 of the exemplary embodiment should easily fit between the bottom of the dispenser and the floor or ground surface when the dispenser is supported on the slides. This requirement is a function of the dimensions of chest 20, presenter 35 and the size and number of dispenser modules used in the dispenser. In the event that a dispenser with only one dispenser module 33 is used with presenter 35, the carrier may be used in the manner described by employing a spacer between the lower surface of the single dispenser module and the carrier. This enables the lifting device of the carrier to lift the dispenser by engaging the floor surface. Such a suitable spacer may include a structure similar to that of a dispenser module without cassettes therein. Of course other suitable spacers may also be used.

Furthermore, if the vertical space between interlocking surfaces 74 and 75 remains too large when the carrier 50 is moved under the lower module 33, then the cradle 64 may be raised to permit interlocking of surfaces 74 and 75. The latching devices 78 may then be engaged. The cradle may then be further raised to lift the dispenser as previously explained.

The carrier may include a locking mechanism for permitting the cradle to be locked in any elevated position. This feature permits a service person to disengage their foot from the cradle. The service person is then free to move about the dispenser for aligning, latching, inspecting, handling, or other purposes.

Figure 16:
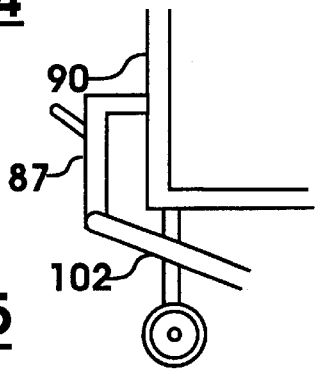
FIG. 16 is a side view of a carrier portion with an extending device.

Additionally, the pressing of a service person's foot on the cradle may be replaced by a more complex pressing or extending device 87 (FIG. 16), such as a mechanical jack, or a pneumatic, hydraulic, or electromagnetic device. The operation of such devices for the lifting of the dispenser may be controlled by a hand-held controller. Use of such a controller would permit the operator the capability of walking around the carrier and dispenser to better view and inspect the carrier and dispenser during alignment and inspections.

The pin 82 and detent 83 arrangement for disengagement may be replaced or supplemented. Other arrangements for releasably connecting a dispenser to the slides 40 may be used. For example, such other arrangements may include quick connect and disconnect latches, rollers, or screws, etc. These other arrangements may also be used as a backup supporting arrangement to the pin and detent supporting arrangement. Such a backup arrangement would provide an additional level of supporting engagement between the dispenser and the slides 40.

Additionally, the carrier 50 may have attached thereto at least one shaft and handle (e.g., wagon) arrangement. Such an arrangement would permit ease of transport of the carrier when either supporting or not supporting the dispenser. The carrier may also be arranged to use different sized wheels or casters 60. The wheel size could be chosen to provide the vertical spacing necessary so that surfaces 74 and 75 align and interlock. The carrier may also be arranged to use different sized cradles 64. The cradle size and wheel size could be coordinated to provide both the necessary vertical spacing and the necessary vertical lifting.

Figure 10:
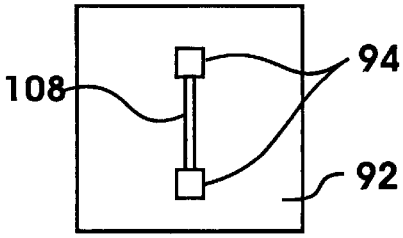
FIG. 10 is a detail view of a plate and lower piece arrangement for use in the carrier of FIG. 9.
Figure 13:
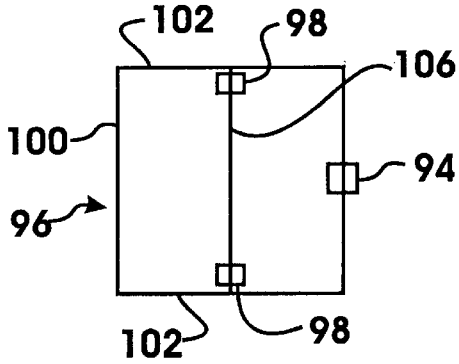
FIG. 13 is detail view of a cradle arrangement for use in the carrier of FIG. 9.
Figure 11:
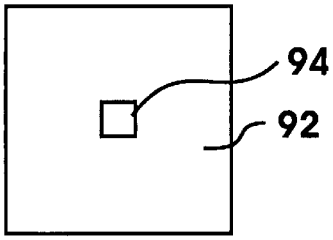
FIG. 11 is a detail view of a plate and lower piece arrangement for use in the carrier of FIG. 9.
Figure 12:
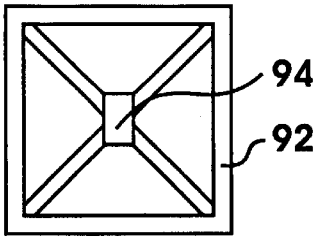
FIG. 12 is a detail view of a plate and lower piece arrangement for use in the carrier of FIG. 9.
Figure 9:
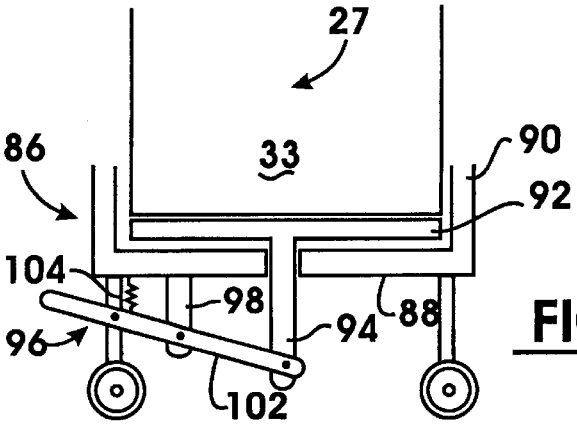
FIG. 9 is a side view of an exemplary portable carrier used in connection with an embodiment of the invention.

A further exemplary embodiment of the portable carrier of the present invention is shown in FIG. 9. Carrier 86 includes a bottom wall 88, side walls 90, and dispenser support plate 92. Plate 92 may comprise a solid plate (FIGS. 10 and 11) or a plate (FIG. 12) having openings to reduce materials and costs. The plate may also include projections, similar to projections 75 on carrier 50, for enhanced alignment. The plate 92 may be solid, mesh, metal, plastic, or any combination of materials. The plate 92 may be of any size or shape or material that enables the plate to support the dispenser 27 in arrangement with the carrier 86. The plate 92 includes a lower piece 94 attached to a cradle 96. Lower piece 94 extends through bottom wall 88 and a vertically extended guide of the bottom wall, as shown. Lower piece 94 may include one or more lower pieces 94 (FIG. 10). Cradle 96 serves as a lifting device (FIG. 13). The cradle 96 acts as a lever and has levers 102 pivotally connected at lower supports 98 to one or more lower pieces 94. A brace 100 connects the levers 102. A second brace 106 may connect lower supports 98. A third brace 108 may connect lower pieces 94.

The carrier 86 may include removable side walls 90. Any number of removable side walls 90 may be used during the alignment and the lifting. For example, four side walls may be used during lifting to provide alignment and guidance. One or more side walls may be removed during servicing to permit access to the lower sides of the dispenser 27. The walls may be designed to be higher than the bottom of dispenser module 33. The bottom wall 88, with plate 92 thereon, may be designed to be lower than dummy bin 42. Hence, no precise alignment may be necessary during alignment of the plate 92 with the dispenser 27.

Figure 14:
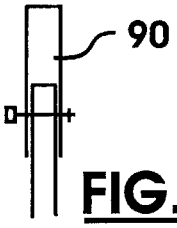
FIG. 14 is a side view of an extendable removable side wall.
Figure 15:
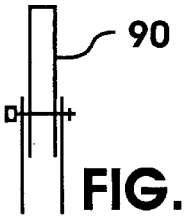
FIG. 15 is a side view of another extendable removable side wall.

In an operation example, the carrier 86 is wheeled into a position under the extended dispenser 27. The dispenser may enter the carrier, having in this example three side walls attached thereto, through an open (removed) side. The three side walls 90 easily align with three sides of the dispenser. Thus the carrier 86 and plate 92 are in substantial alignment with the dispenser for purposes of lifting the dispenser. Once the dispenser is aligned inside the three side walls 90, the last (fourth) side wall 90 may be attached to the carrier to completely enclose the lower portion of the dispenser. The dispenser may be guided by up to four side walls 90 during the lifting. The walls 90 may be designed to provide a close fit with the dispenser, thereby securing the dispenser 27 against tilting or falling out of the carrier 86. Once the dispenser 27 has been lifted above the slides 40 and is supported by the plate 92, then the removal of one or more side walls 90 may occur. The removal of a side wall 90, if necessary, may permit access to components, for example the lower cassettes, that may have been blocked by the side wall 90. Such capability of using removable side walls 90 for alignment, guidance, and securement may facilitate the servicing of the dispenser. Additionally, the side walls 90 and the plate 92 may be padded to prevent scratching or damaging the dispenser, and to reduce vibration of the dispenser and its components during the servicing operation. A non-abrasive material, coating, or any other combination of substances which reduces scratching and vibration may also be used with the side walls 90 and plate 92. Additionally, the removable side walls 90 may comprise telescopic members (FIGS. 14 and 15). The telescopic members may quickly provide an extension of the side walls necessary for alignment, guidance, or securement of the dispenser. One or more pins or rods may also be used to position and secure the telescopic members at extended positions. The telescopic members may also be used to provide a vertical extension of a carrier (such as carrier 50) to reduce vertical spacing between the carrier and the dispenser.

Prior to lifting, the carrier wheels may first be locked, thus securing the carrier and providing a stable lifting arrangement. Locking mechanisms for wheels are known, and such mechanisms may be used for locking the carrier wheels. Also, anti-skid or anti-slip wheels may be used, thus enhancing the prevention of carrier movement when in the wheel-locked position.

The brace 100 may be pressed either by a person's foot or a machine element. The pressing of brace 100 causes levers 102 to pivot about lower supports 98. This pivoting or seesaw type of action causes lower piece 94 and plate 92 to rise, thereby lifting dispenser 27. The brace 100 may be locked in the pressed or elevated state when the lifting is accomplished by an extending device 87 (FIG. 16), such as a jack. Such an elevated state may be beneficial during servicing the dispenser. Additionally, from the elevated state the dispenser may be quickly lowered onto the slides 40. Hence, locking the dispenser in the elevated state above the slides may be useful when the step of lowering the dispenser is unnecessary. The biasing spring 104 is connected to the carrier bottom wall 88 and at least one of the levers 102. The spring biases the levers 102 upward and hence plate 92 downward.

The individual features discussed in the exemplary embodiments of the present invention may be adapted for use with any of the portable carriers discussed herein. For example, the telescopic members may be used to provide an extension of a carrier side walls for purposes of alignment, guidance, or securement of the dispenser, and they also may be used to reduce vertical spacing between a carrier and the dispenser. Likewise, the carrier wheels may be locked in any of the exemplary embodiments of the present invention.

While the exemplary embodiments of the invention include particular structures to achieve the desirable results, those having skill in the art may devise numerous other embodiments with other structures which employ the same inventive principles described herein and which are encompassed by the subject matter as claimed. For example and without limitation, other embodiments of the invention may include other types of carriers, lifting devices, casters, wheels or other structures. Further, the structures described herein are not intended to limit the method of the invention to the particular structures described herein.

Thus the exemplary embodiment of the present invention achieves the above stated objectives, eliminates difficulties encountered in the use of prior devices, and methods, solves problems and attains the desired results described herein.

In the foregoing description certain terms have been used for brevity, clarity and understanding, however, no unnecessary limitations are to be implied therefrom because such terms are intended for descriptive purposes only and are intended to be broadly construed. Moreover, the descriptions and illustrations herein are by way of examples and the invention is not limited to the exact details shown and described.

In the following claims, any feature described as a means for performing a function shall be construed as encompassing any means known to those skilled in the art to be capable of performing the recited function and shall not be deemed limited to the particular structure shown herein or equivalents thereof.

Having described the features, discoveries and principles of the invention, the manner in which it is constructed and operated, and the advantages and useful results attained; the new and useful structures, devices, elements, arrangements, parts, combinations, systems, operations, methods and relationships are set forth in the appended claims.

I claim:

1. A method comprising the steps of:

a) engaging a portable carrier to a sheet dispenser of an automated banking machine; and b) lifting the sheet dispenser by moving a device operatively connected to the carrier, wherein the sheet dispenser is supported on the portable carrier.

2. The method according to claim 1 wherein the device comprises a lever device pivotally connected to the carrier, and wherein step (b) comprises:

lifting the sheet dispenser by applying a force to the lever device.

3. The method according to claim 2 wherein the force applied to the lever device is manually applied.

4. The method according to claim 2 wherein the force applied to the lever device is applied by an extendable apparatus device.

5. The method according to claim 2 wherein the portable carrier comprises a portable wheeled carrier, and prior to step (a) further comprising the step of:

positioning the portable wheeled carrier generally beneath the sheet dispenser.

6. The method according to claim 2 wherein the carrier comprises a movable plate operatively connected to the lever device, and wherein step (a) comprises:

engaging the movable plate to the sheet dispenser, and wherein step (b) comprises lifting the sheet dispenser while the sheet dispenser is engaged to the movable plate.

7. The method according to claim 1 and prior to step (a) further comprising the step of:

c) moving the sheet dispenser from a position interior of a housing of an automated banking machine to a position exterior of the housing, wherein in the exterior position the sheet dispenser is in supporting connection with the housing.

8. The method according to claim 7 wherein step (b) comprises:

disengaging the sheet dispenser from supporting connection with the housing.

9. The method according to claim 8 wherein the housing comprises an opening and at least one extendable slide, and wherein step (c) comprises:

moving the sheet dispenser to the exterior position through the opening in supporting connection with the slide, and wherein step (b) comprises disengaging the sheet dispenser from supporting connection with the slide.

10. The method according to claim 9 wherein in step (b) disengaging the sheet dispenser from supporting connection with the slide further comprises the step of:

manually engaging at least one handle operatively connected with an upper portion of the sheet dispenser and controlling a movement of the sheet dispenser with the handle so as to disengage the sheet dispenser from supporting connection with the slide.

11. The method according to claim 9 wherein step (a) comprises the steps of:

engaging alignment devices on the sheet dispenser and the carrier, and activating a latching device to secure the carrier and the sheet dispenser in engaged relation.

12. The method according to claim 9 wherein the device comprises a foot actuated lever device, and wherein step (b) comprises:

lifting the sheet dispenser by pressing downward on a portion of the foot actuated lever device.

13. The method according to claim 12 wherein the foot actuated lever device is operative to lift the sheet dispenser by engaging a curved portion with a floor surface, and wherein the carrier comprises a biasing device in operative connection with the foot actuated lever device, and subsequent to step (b) further comprising the step of:

moving the foot actuated lever device away from the floor surface responsive to the biasing device.

14. The method according to claim 12 further comprising the step of:

forcing with a foot a first end of the foot actuated lever device downward towards a floor surface, wherein a second end of the lever device operatively engaged to the sheet dispenser is disposed upward.

15. The method according to claim 14 wherein the lever device comprises a generally curved portion between the first and second ends, and wherein in step (b) the sheet dispenser is lifted responsive to the curved portion engaging the floor surface.

16. The method according to claim 12 further comprising the step of:

moving the slide relative to the sheet dispenser in the lifted position of the sheet dispenser, wherein the slide is disposed from the sheet dispenser.

17. The method according to claim 16 wherein after moving the slide relative to the sheet dispenser, further comprising the step of:

lowering the sheet dispenser by moving the foot actuated lever device.

18. The method according to claim 16 wherein in step (b) disengaging the sheet dispenser from supporting connection with the slide further comprises the step of:

manually engaging at least one handle operatively connected with an upper portion of the sheet dispenser, wherein a positioning of the sheet dispenser is enabled to be controlled relative to the slide.

19. The method according to claim 9 wherein in step (b) disengaging the sheet dispenser from the slide comprises the step of:

lifting the sheet dispenser relative to the slide, wherein the sheet dispenser is disengaged from supporting connection with the slide.

20. The method according to claim 19 wherein subsequent to step (b) further comprising the step of:

retracting the slide into the housing, wherein the slide is disposed from the sheet dispenser.

21. The method according to claim 19 wherein subsequent to step (b) further comprising the step of:

lowering the sheet dispenser in supporting connection with the carrier, wherein the sheet dispenser is lowered responsive to removing a force on a lever device operatively connected to the carrier.

22. The method according to claim 19 wherein the portable carrier comprises a portable wheeled carrier, and prior to step (a) further comprising the step of:

positioning the portable wheeled carrier generally beneath the sheet dispenser.

23. The method according to claim 22 wherein the carrier comprises lockable wheels, and prior to step (b) further comprising the step of:

locking the wheels.

24. The method according to claim 23 wherein the carrier comprises at least two extendable side portions, and prior to step (b) further comprising the step of:

extending the at least two extendable side portions.

25. The method according to claim 19 wherein subsequent to step (b) further comprising the step of:

moving the sheet dispenser supported on the carrier away from the housing.

26. The method according to claim 7 further comprising the step of:

servicing the sheet dispenser in supporting connection with the carrier.

27. The method according to claim 26 further comprising the step of:

(d) engaging the sheet dispenser and the slide.

28. The method according to claim 27 wherein step (d) comprises lifting the sheet dispenser with the lifting device in operative connection with the carrier.

29. The method according to claim 28 further comprising the steps of:

disengaging the carrier from the sheet dispenser; and moving the sheet dispenser into the housing by retracting the slide.

30. The method according to claim 29 further comprising the steps of:

closing the opening with a door, and securing the door in the closed position with a lock.

31. The method according to claim 30 wherein the door includes a sheet opening therethrough, and further comprising the step of:

moving a sheet from the sheet dispenser through the sheet opening.

32. A method comprising the steps of:

a) moving a sheet dispenser through an opening of a housing of an automated banking machine to an extended position, wherein in the extended position the sheet dispenser is in supporting connection with the housing;

b) engaging a portable carrier to the sheet dispenser;

c) lifting the sheet dispenser by moving a device operatively connected to the carrier; and d) disengaging the sheet dispenser from supporting connection with the housing, wherein the sheet dispenser is supported on the carrier.

33. The method according to claim 32 wherein step (a) comprises:

moving the sheet dispenser to the extended position through the opening in supporting connection with at least one extendable slide connected to the housing, and wherein step (d) comprises lifting the sheet dispenser relative to the slide, wherein the sheet dispenser is disengaged from supporting connection with the slide.

34. The method according to claim 33 wherein the portable carrier comprises a portable wheeled carrier, and prior to step (b) further comprising the step of:

positioning the portable wheeled carrier generally beneath the sheet dispenser.

35. The method according to claim 33 wherein the device comprises a lever device pivotally connected to the carrier, and wherein step (c) comprises:

lifting the sheet dispenser by applying a force to the lever device.

36. The method according to claim 35 wherein the lever device comprises a foot actuated lever device, and wherein step (c) comprises:

lifting the sheet dispenser by pressing downward on a portion of the foot actuated lever device.

37. The method according to claim 36 wherein the portable carrier comprises a portable wheeled carrier, and prior to step (b) further comprising the step of:

positioning the portable wheeled carrier generally beneath the sheet dispenser.

38. The method according to claim 34 wherein the foot actuated lever device is operative to lift the sheet dispenser by engaging the curved portion with the floor surface, and wherein the carrier comprises a biasing device in operative connection with the foot actuated lever device, and subsequent to step (d) further comprising the step of: moving the foot actuated lever device away from the floor surface responsive to the biasing device.

39. The method according to claim 37 wherein the foot actuated lever device comprises a generally curved portion between first and second ends, and wherein in step (c) the sheet dispenser is lifted responsive to the curved portion engaging a floor surface.

40. The method according to claim 37 wherein the carrier comprises a movable plate operatively connected to the foot actuated lever device, and wherein step (b) comprises:

engaging the movable plate to the sheet dispenser, and wherein step (c) comprises lifting the sheet dispenser while the sheet dispenser is engaged to the movable plate.

* * * * *